United States Patent [19]

Henkel

[11] Patent Number: 4,729,325

[45] Date of Patent: Mar. 8, 1988

[54] BOLSTER WITH IMPROVED BRAKE ASSEMBLY MOUNTING ARRANGEMENT

[75] Inventor: James A. Henkel, Park Forest, Ill.

[73] Assignee: AMSTED Industries Incorporated, Chicago, Ill.

[21] Appl. No.: 848,788

[22] Filed: Apr. 7, 1986

[51] Int. Cl.[4] ..... B61F 1/08; B61F 5/50

[52] U.S. Cl. ..... 105/226; 188/208

[58] Field of Search ..... 105/226, 227, 228, 229, 105/230, 182.1, 200; 188/206 R, 205 R, 208, 209, 215

[56] References Cited

U.S. PATENT DOCUMENTS

| | | | |
|---|---|---|---|
| 1,988,235 | 1/1935 | Busch | 188/205 R |
| 2,003,341 | 6/1935 | Campbell | 105/228 |
| 2,419,188 | 5/1947 | Milleville | 105/200 |

*Primary Examiner*—David A. Scherbel

*Attorney, Agent, or Firm*—Edward J. Brosius; Charles E. Bouton

[57] ABSTRACT

A bolster having a plurality of flat surfaces on the opposite side thereof arranged to provide a surface on which the saddles of an air brake assembly are fastened.

4 Claims, 4 Drawing Figures

BOLSTER WITH IMPROVED BRAKE ASSEMBLY MOUNTING ARRANGEMENT

FIELD OF THE INVENTION

The present invention relates to railway vehicles and more particularly to a railway vehicle truck bolster having an improved arrangement for attaching a brake assembly thereon.

BACKGROUND OF THE INVENTION

Railway vehicle truck bolsters of different manufacture origin and also of different vehicle capacity may vary in contour and/or shape. This difference in shape has required that the air brake assemblies, for braking the truck wheels, which are normally mounted on the bolster be attached by fabricated parts of different construction. Such fabrication oftentimes used tie bolts and space bars and under some circumstances interfered with the installation of well-known auxiliary car control devices. The fabrication and different mounting arrangements tended to increase the installation and maintenance costs of the air brake assembly due to the additional parts required for mounting to the truck bolster. In addition, parts could not be pre-manufactured since many of the items required custom fitting to the various contours and hole locations of truck bolsters. Split orders from a customer often required two different attachments, thus interchangeability was not possible.

SUMMARY OF THE PRESENT INVENTION

By the present invention it is proposed to provide the bolsters of different manufacture and design with a standard or universal attachment arrangement for mounting the air brake assembly and thereby obviate the necessity of different attachment arrangements for the different truck shapes and contours.

This is accomplished generally by providing a railway vehicle truck bolster with a plurality of projecting bosses on each exterior side of the bolster and terminating in flat surfaces lying in a vertical plane which is parallel to the major axis of the bolster. The bosses are arranged in a triangular pattern forming preferably an inverted isosceles triangle. The bosses are also each provided with bores for receiving attachment means for attaching the brake assembly.

The inner wall of each bolster side may also be provided with bosses aligned with the projecting bosses. The inner bosses are formed with flat surfaces against which nuts may be securely tightened when nut and bolt assemblies are used to fasten the air brake assembly on the bolster.

Further features of the present invention will be apparent from the following description.

DESCRIPTION OF THE PREFERRED EMBODIMENT

Figures 1, 4:
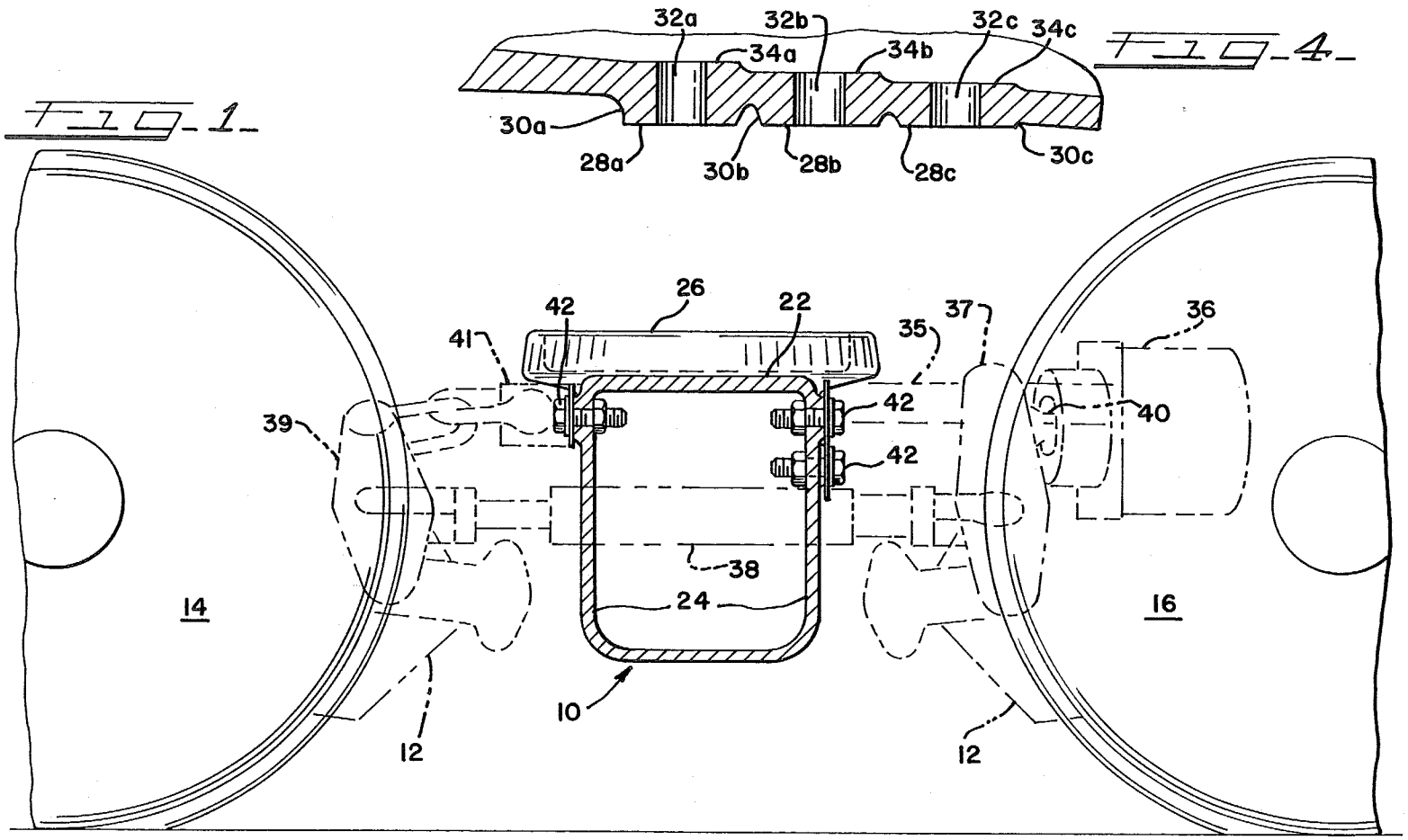
FIG. 1 is a side elevational view of a Railcar truck with parts removed to show a truck bolster embodying the structure of the present invention with a fragmentary and schematic illustration of an air brake assembly shown in phantom lines.
FIG. 4 is a cross sectional view taken generally along the lines 4—4 of FIG. 2.
Figure 2:
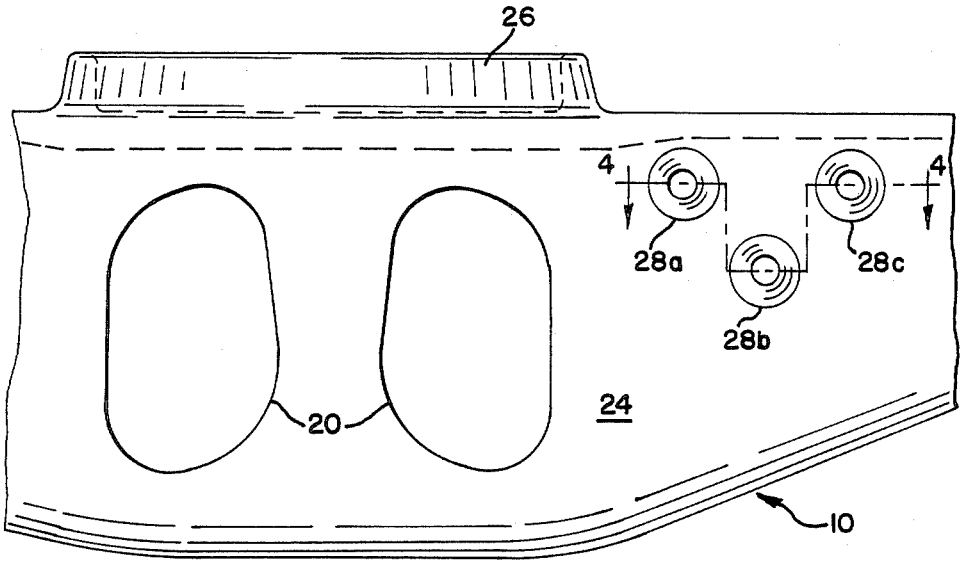
FIG. 2 is a fragmentary side elevational view of the bolster shown in FIG. 1.
Figure 3:
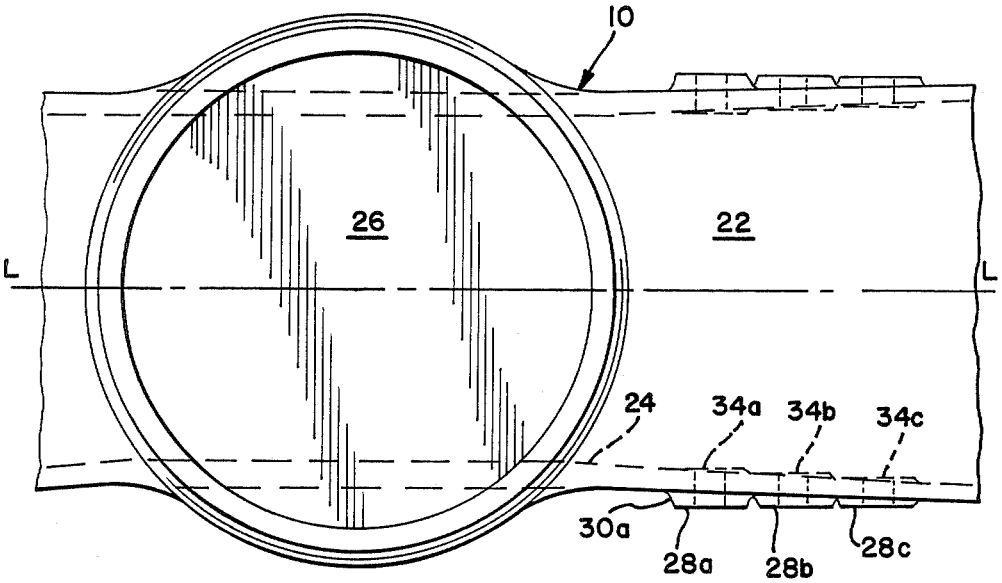
FIG. 3 is a fragmentary top plan view of the bolster shown in FIG. 2.

Referring now to the drawings there is shown a railway vehicle truck bolster generally 10 supported between side frames (not shown) on a four wheel truck assembly. The truck assembly includes two pairs of wheel sets including wheels 14, 16. Mounted on the bolster 10 as shown in phantom lines is the cylinder mounting assembly 35 which in turn supports the cylinder 36. Reaction from the cylinder push rod 40 exerts a force through the live lever 37, slack adjuster 38 and dead lever 39 to actuate the brake beams 12 to engage with the treads of the wheels 14, 16 when the cylinder 36 is operated in the conventional manner.

The bolster 10 is made of cast steel and includes a top or horizontal web 22 from which there depends downwardly extending side walls 24. Openings 20 are cast in the side walls 24 to provide adequate space for the slack adjuster 38 under various truck and brake conditions. A center plate 26 is formed on the top web 22 intermediate ends of the bolster. The side walls 24 may taper from center plate 26 toward the free ends of the bolster. Also the side walls 24 may be of various contours along the length thereof. The taper and contour of the side walls 24 may vary on bolsters made by different manufacturers and also may vary when made by the same manufacturer but of different design to accommodate different car capacities. Heretofore the air brake cylinder 36 has been mounted on saddle arrangements which have been placed across both sides of the bolster 10 and secured by means of plural long bolts and spacers extended across the bolster top and core hole located in the mid portion of side wall 24 and which bolts and spacers were cut to lengths to conform to the varying width dimensions of each specific bolster 10.

In accordance with the present invention there is provided an arrangement to obviate the necessity for providing different saddles or other air brake attachment means to accommodate the different shapes and contours of different manufacturer's bolsters. To this end there is provided one or more flat planar outward attachment surfaces cast directly in the bolster walls 24 preferably in the form of spaced outward surfaces **28*a*, 28*b* and 28*c*. The spaced flat surfaces 28*a*, 28*b* and 28*c* lie in a common vertical plane which is spaced from and parallel to the major axis L of the bolster 10**.

The flat surfaces **28*a*, 28*b* and 28*c* are formed on the ends of bosses 30*a*, 30*b* and 30*c*, cast so as to project outwardly from the side walls 24. The bosses 30*a*, 30*b* and 30*c* are arranged in a geometrical pattern preferably in the form of an inverted isosceles triangle. Such a triangular arrangement prevents or minimizes the tendency of the air brake unit to twist when mounted on the bolster 10. If desired the accuracy of the planar relationship may be improved by machining the outward surfaces 28*a*, 28*b* and 28*c***. Preferably the bosses are located at standardized distances between themselves and from the bolster center so as to permit standardization of the brake assembly mountings.

Bosses **30*a*, 30*b* and 30*c* are located on both opposite side walls 24 of bolster 10 to facilitate both right hand and left hand brake arrangements often required in car design. To one set of pads 28*a*, 28*b* and 28*c* are mounted the cylinder mounting assembly 35, whereas, the top two pads 28*a* and 28*c* of the opposite side are used for mounting of the dead lever bracket 41**.

Extending through each of the bosses 30*a*, 30*b* and 30*c* are bores 32*a*, 32*b* and 32*c*, respectively, for accommodating the shanks of the fastening bolts. In a preferred embodiment the outward surfaces are of sufficient diameter to provide a flat seat for attachment of the cylinder mounding bracket 35 and dead lever bracket 41, and the bores of sufficient diameter to accept the mounting bolts 42. Flat interior surfaces 34*a*, 34*b* and 34*c* may be cast on the inner surface of the side walls 24 in alignment with the flat outward surfaces 28*a*, 28*b* and 28*c*, respectively, to provide seats against which nuts may be tightened on relatively short bolts by reaching through a brake rod hole 20.

It should be readily apparent from the foregoing description that the flat outward surfaces 28*a*, 28*b* and 28*c* provide a universal mounting surface against which the cylinder mounting assembly 35 and the dead lever bracket 41 may be mounted and secured either directly or by standardized pads. This obviates the necessity of designing or fabricating a variety of different attachment arrangements for bolsters of different manufacturing source or capacity.

What is claimed is:

1. In a railway vehicle truck bolster including a top web, a center plate located substantially intermediate the ends thereof and walls depending from said top web, a brake assembly mounting arrangement for mounting the brake assembly on said bolster, said mounting arrangement comprising three separate circular raised bosses disposed in a triangular pattern projecting from each of said side walls, said bosses terminating in flat exterior surfaces lying in a common plane parallel to the longitudinal axis of said bolster, and a bore formed in each of said bosses for receiving bolts of nut and bolt assemblies used to fasten said brake assembly to said bolster, said bosses having flat interior surfaces that are in planar alignment with the bosses flat outer surfaces to provide separate seats for each of said nut and bolt assemblies.

2. The invention as defined in claim 1 wherein said bosses are located on opposite bolster side walls to allow right hand or left hand brake assembly as required by car design.

3. The invention as defined in claim 1 wherein said triangular pattern is in the form of an isosceles triangle.

4. The invention as defined in claim 3 wherein said pattern of bosses are located adjacent to said center plate.

* * * * *